United States Patent [19]

Takada et al.

[11] 4,442,201

[45] Apr. 10, 1984

[54] METHOD FOR PRODUCTION OF A SILVER HALIDE PHOTOGRAPHIC LIGHT-SENSITIVE MATERIAL

[75] Inventors: Syun Takada; Takashi Kadowaki; Mitsuhiro Okumura, all of Odawara; Shinichi Nakamura, Tokyo; Masaru Iwagaki, Hachioji, all of Japan

[73] Assignee: Konishiroku Photo Industry Co., Ltd., Japan

[21] Appl. No.: 395,998

[22] Filed: Jul. 7, 1982

[30] Foreign Application Priority Data

Jul. 7, 1981 [JP] Japan ..... 56-106412

[51] Int. Cl.[3] ..... G03C 1/02

[52] U.S. Cl. ..... 430/569; 430/570; 430/571; 430/572; 430/573; 430/574; 430/576; 430/577

[58] Field of Search ..... 430/569, 570, 571, 572, 430/605, 573, 574, 576, 577

[56] References Cited

U.S. PATENT DOCUMENTS

| | | | |
|---|---|---|---|
| 1,573,596 | 2/1926 | Wall et al. | 430/572 |
| 4,153,462 | 5/1979 | Gerber et al. | 430/571 |
| 4,225,666 | 9/1980 | Locker et al. | 430/570 |
| 4,332,888 | 6/1982 | Corben | 430/570 |

*Primary Examiner*—J. Travis Brown

*Attorney, Agent, or Firm*—Finnegan, Henderson, Farabow, Garrett & Dunner

[57] ABSTRACT

A method for producing a silver halide photographic light-sensitive material having on a support thereof at least one layer formed of an emulsion containing light-sensitive silver halide particles sensitized by a sensitizing dye comprising the steps of adding a first sensitizing dye to an emulsion containing silver halide particles, during the chemical ripening of the silver halide particles, to sensitize the silver halide particles; adding a second sensitizing dye to the emulsion containing the sensitized silver halide particles, after the chemical ripening of the silver halide particles, to form a coating liquid; and coating a support with the coating liquid to produce a silver halide photographic light-sensitive material.

8 Claims, No Drawings

METHOD FOR PRODUCTION OF A SILVER HALIDE PHOTOGRAPHIC LIGHT-SENSITIVE MATERIAL

The present invention relates to an improvement in the stability of a silver halide photographic emulsion coating liquid during the period between the preparation of the silver halide photographic emulsion and the coating thereof on the support in the production of a silver halide photographic light-sensitive material.

In the production of a silver halide photographic light-sensitive material there is a process to mix various additives such as a binder, surfactant, hardener, coupler, mordant, with spectrally sensitized, chemically ripened silver halide particles to thereby prepare a silver halide photographic emulsion coating liquid (hereinafter referred to as a coating liquid). It is well known that this coating liquid is coated on a support in various manners and then dried to produce a silver halide photographic light-sensitive material.

The coating liquid, after the preparation thereof, is stored for several to several tens of hours at a given temperature until it is to be coated, but during this period the quality of the finished silver halide photographic material must always be constant. However, the coating liquid containing the spectrally sensitized silver halid photographic emulsion varies in the speed and gradation and increases in fog with time, so that it is the fact that an improvement in these characteristics has been desired.

In order to prevent the coating liquid from the change in these characteristics, particularly in the speed during the storage thereof, there have been proposed, for example, the addition of azole or azaindene compounds known as stabilizers; the addition of a reducing agent such as, e.g., hydroquinones, sulfinic acids, and the combined use of a specific copolymer and a brightening agent as described in Japanese Patent Publication Open to Public Inspection (hereinafter referred to as Japanese Patent O.P.I. Publication) No. 111629/1974, but these techniques cannot be considered sufficiently effective for the purpose.

Thus it is a first object of the present invention to provide a silver halide photographic light-sensitive material having always a constant quality.

It is a second object of the present invention to provide such a stable silver halide photographic emulsion coating liquid as to have very little changes in the characteristics over an extensive period of time.

As a result of having studied how to prevent the coating liquid from changes in the characteristics thereof in storage, we have found that the above objects may be attained by such a procedure that in the method for the production of a silver halide photographic light-sensitive material having on the support thereof at least one layer formed of an emulsion containing light-sensitive silver halide particles sensitized by a sensitizing dye, a solution prepared by dissolving a second sensitizing dye is added to the said emulsion, whose silver halide particles have been sensitized by a first sensitizing dye, after the chemical ripening thereof and prior to the coating thereof.

Preferred first and second sensitizing dyes applicable to the present invention include those compounds having Formulas (I) through (VII):

[I]

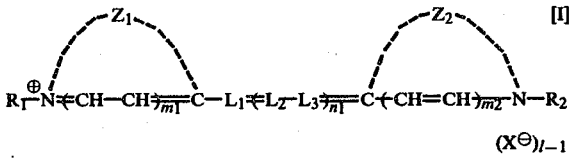

$(X^{\ominus})_{l-1}$

[II]

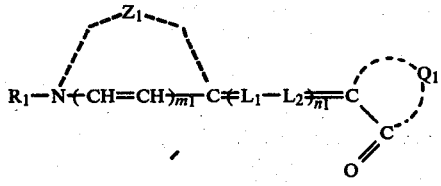

[III]

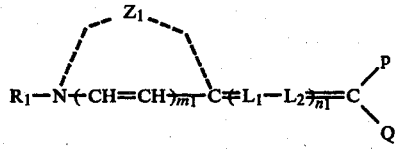

[IV]

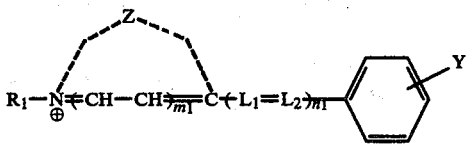

$(X^{\ominus})_{l-1}$

[V]

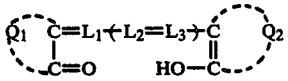

[VI]

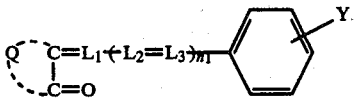

[VII]

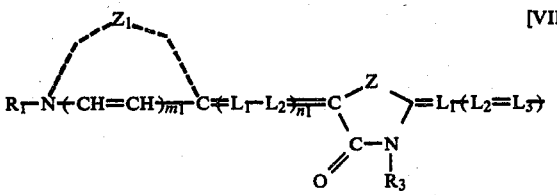

$(X^{\ominus})_{l-1}$ wherein $R_1$, $R_2$ and $R_3$ each is a group selected from the class consisting of an alkyl (such as methyl, ethyl, propyl), a substituted alkyl (such as chloroethyl, hydroxyethyl, methoxyethyl, acetoxyethyl, carboxymethyl, carboxyethyl, ethoxycarbonylmethyl, sulfoethyl, sulfopropyl, sulfobutyl, β-hydroxy-γ-sulfopropyl, sulfatepropyl, allyl, benzyl) and an aryl (such as phenyl, carboxyphenyl, sulfophenyl); $L_1$, $L_2$ and $L_3$ each is methinyl or substituted methinyl (such as —CH=, —C(CH$_3$)=, —C(C$_2$H$_5$)=, -continued

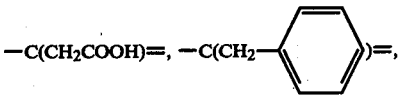

$-C(C_6H_5)=$, $-C(C_6H_4COOH)=$, etc.);

$Z_1$, $Z_2$ and $Z_3$ each is an atom or a group of atoms necessary to complete a 5- or 6-member heterocyclic nucleus (such as of thiazoline, oxazoline, selenazoline, thiazole, selenazole, oxazole, benzothiazole, benzoxazole, benzimidazole, 3,3-di-alkyl-indolenine, naphthothiazole, naphthoxazole, naphtho-selenazole, thienothiazole, 2-pyridine, 4-pyridine, 2-quinoline, 4-quinoline, etc.); P and Q each is cyano, $COOR_4$, $COR_4$, $SO_2R_4$ wherein $R_4$ is an alkyl; $Q_1$ and $Q_2$ each is a group of atoms necessary to form a substituted or unsubstituted thiooxazolone ring, pyrazolone ring, oxyindole ring, barbituric acid, 2-thiobarbituric acid, 2,4-oxazolidine-dione, 2,4-thiazolidine-dione 2,4-imidazolidine-dione, 2-thio-2,4-oxazolidine-dione, 2-thio-2,4-thiazolidine-dione, 2-thio-2,4-selenazolidine-dione, 2-thio-2,5-thiazolidine-dione, 2-thiohydantoin ring, 4-oxa-zolinone ring, 4-thiazolinone ring or 4-imidazolinone ring; Y is hydrogen or a group selected from the group consisting of amino, an alkylamino (such as ethylamino), a dialkylamino (such as dimethylamino), a halogen (such as Cl, Br), an alkoxy (such as ethoxy), and an alkyl (such as methyl); $m_1$ and $m_2$ each is 0 or 1; $n_1$ and $n_2$ each is 0 or 2; X is an anion group (such as Cl, Br, I, ClOCl, $CH_3$— 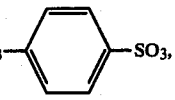 —$SO_3$, $CH_3SO_4$, $C_2H_5SO_4$, etc.);

and l is 1 or 2, provided when the compound forms an inner salt, l is 1.

The following are typical examples of those sensitizers of the present invention having the foregoing formulas, but those compounds applicable to the present invention are not limited thereto:

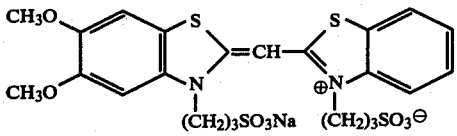

(1)

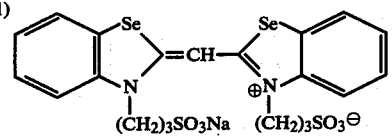

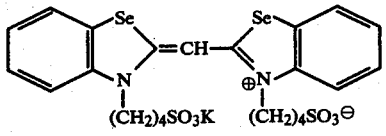

(3)

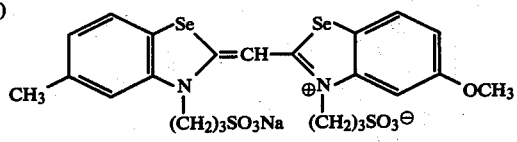

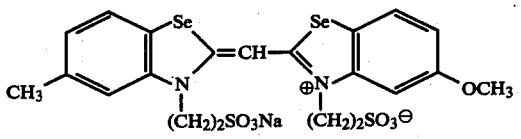

(5)

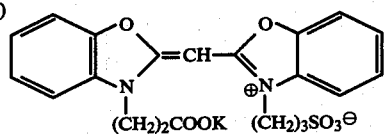

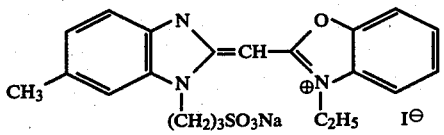

(7)

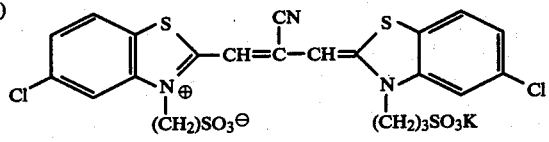

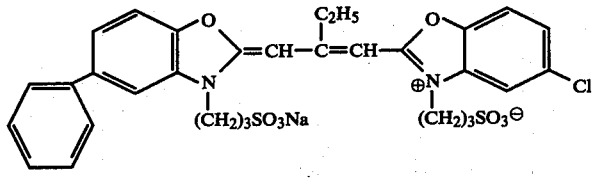

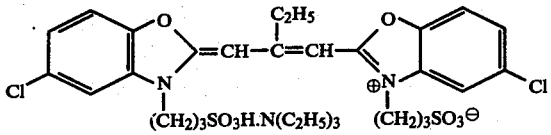

-continued
(11)
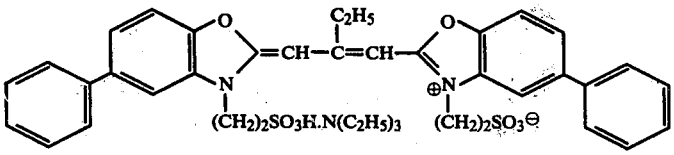
(12)
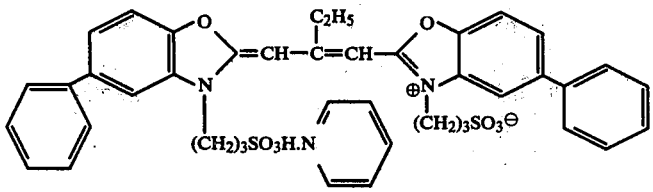
(13)
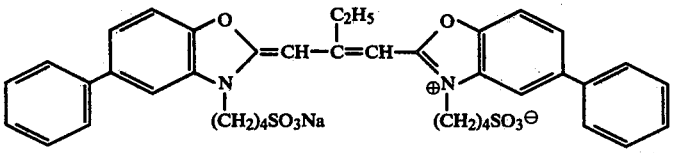
(14)
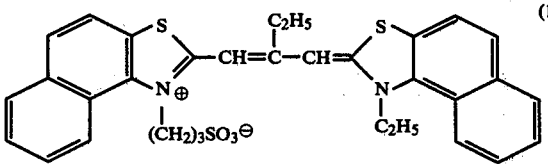
(15)
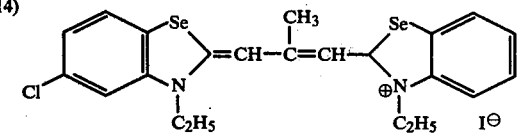
(16)
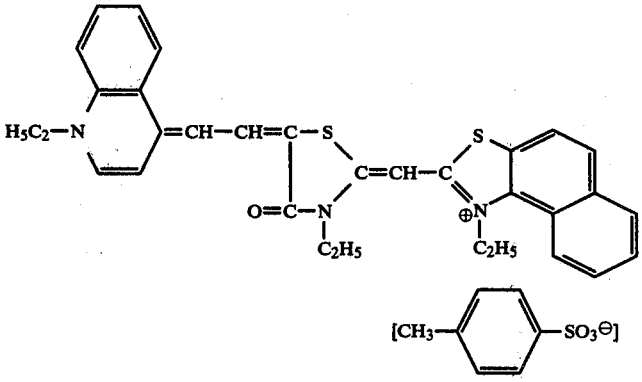
(17)
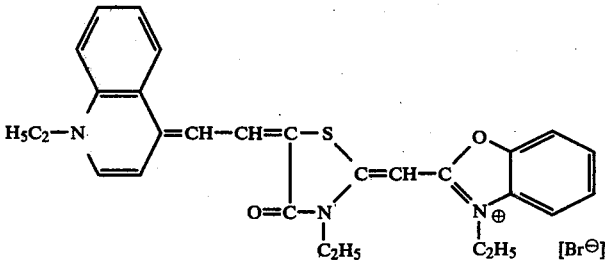
(18)
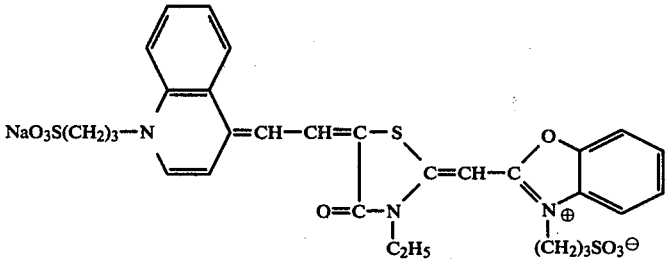

-continued
(19)
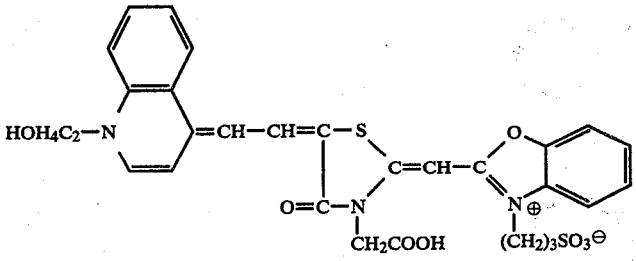
(20)
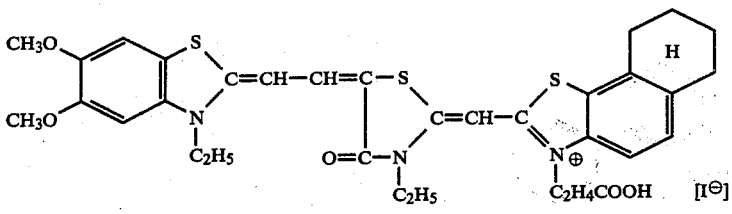
(21)
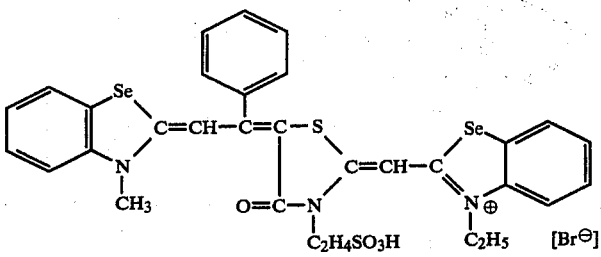
(22)
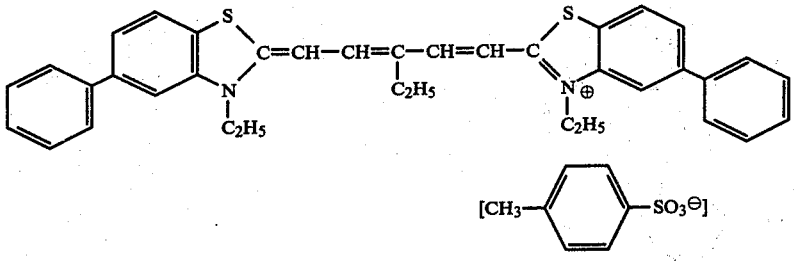
(23)
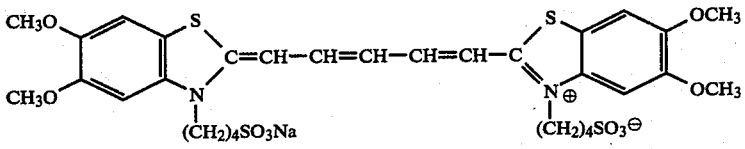
(24)
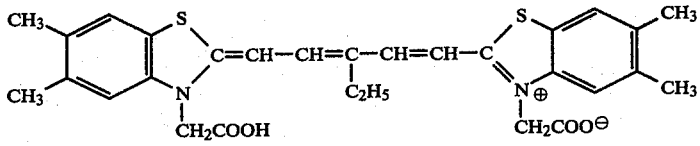
(25)
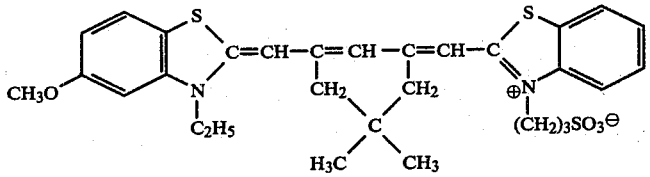

-continued

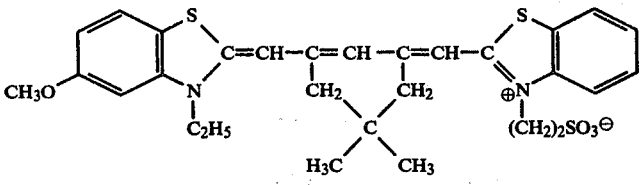

(26)

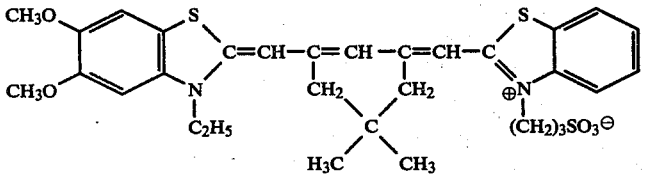

(27)

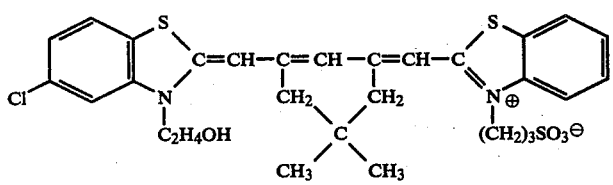

(28)

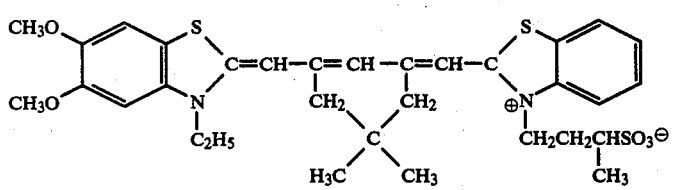

(29)

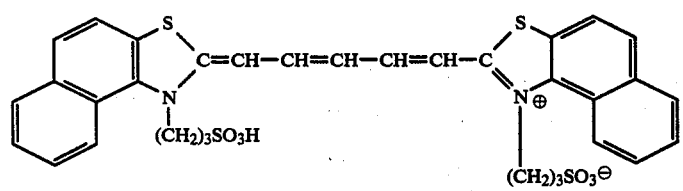

(30)

The first sensitizing dye and the second sensitizing dye may be different each other but preferably the same.

In order to add these sensitizing dyes of the present invention to a hydrophilic colloid containing silver halide particles, any of these sensitizing dyes should be added in the form of a solution prepared by dissolving it into water or such an organic solvent arbitrarily miscible with water as methanol, ethanol, fluorinated alcohol, 1,4-butanediol, dimethyl formamide, dioxane, benzene, chloroform, pyridine, ligroin, acetone, triethylene glycol monomethyl ether, triethanolamine, methyl cellosolve, ethyl cellosolve, phenyl cellosolve, or the like, these solvents being permitted to be used singly or in combination of not less than two kinds thereof.

In the present invention, the quantity of the second sensitizing dye to be added to the emulsion after the chemical ripening thereof and prior to the coating thereof is preferably from 5 to 500% by weight of the amount that the first sensitizing dye have been used.

In the present invention, the first sensitizing dye is preferably added the emulsion of this invention during the chemical ripening thereof and may be added dividedly twice or more.

For the silver halide emulsion to be used in the present invention, silver chloride, silver bromide, silver iodide, and mixed silver halides such as silver chlorobromide, silver iodobromide, silver chloroiodobromide and the like may be used. The preparation, dispersion and physical ripening of these silver halides may be made in normal manners including the sequential mixing process, reverse mixing process, double jet process, and the complex of these processes, totally ammoniacal process, patially ammoniacal process, alkaline process, neutral process, acid process, and the complex of these processes, and in addition the functional addition process, silver halide-conversion process, uniform precipitation process, and the like. Particularly, the present invention may be effectively applied to monodispersive silver halide paticles obtained by the functional addition process. The average particle diameter of the silver halide particles are not particularly to be specified, but desired to be in the range of from 0.01$\mu$ to 3$\mu$. Separately formed two or more different silver halide emulsions may be mixed to be used in this invention.

The silver halide emulsion to be used in the present invention may be chemically sensitized by such methods under usually applied conditions as the gold sensitization method using a gold complex salt, the reduction sensitization method using a reducing agent, the sulfur sensitization method using a compound containing sulfur reactable with silver ions or using the so-called active gelatin, a sensitization method that uses a salt of a noble metal belonging to Group VIII of the Periodic Table, and the like. To the thus obtained silver halide emulsion may be added various compounds in order to prevent the emulsion from the deterioration of the sensitivity thereof or the occurrence of fog thereon, said compounds including 4-hydroxy-6-methyl-1,3,3a,7-tetraazaindene, 3-methyl benzothiazole, 1-phenyl-5-mercaptotetrazole, various heterocyclic compounds, mercapt compounds, metallic salts, and the like.

In the present invention, as the binder material or protective colloid for the photographic emulison, gelatin is advantageously used, but in addition to this, other hydrophilic colloids may also be used; for example, various synthetic hydrophilic macromolecular materials such as gelatin derivatives, graft polymers of gelatin with other macromolecular materials; such cellulose derivatives as hydroxyethyl cellulose, carboxymethyl cellulose, cellulose sulfates, and the like; single- or copolymers such as polyvinyl alcohol, polyvinyl alcohol partial acetal, poly-N-vinyl pyrolidone, polyacrylic acid, polymethacrylic acid, polyacrylamide, and the like.

And into the silver halide emulison coating liquid of the present invention, there may be incorporated such additives as known development accelerators, surfactants, deforming agents, antistatic agents, hardeners, layer's physical property improving agents, antistain agents, sharpness improving agents, mordants, brightening agents, and the like.

The silver halide photographic emulsion of the present invention is generally coated on an appropriate support and then dried to thereby produce a silver halide photographic light-sensitive material, the support to be used in which includes such supports made of paper, glass, cellulose acetates, cellulose nitrate, polyesters, polyamides, polystyrenes, and the like, and further, laminated supports in combination of not less than two different bases such as paper and polyolefins (e.g., polyethylene, polypropylene, etc.).

For the improvement in the adherence to the silver halide emulsion, the support is generally subjected to such various surface improving treatments as, e.g., electronic impact treatments or subbing treatments to provide a subbing layer thereon.

The coating and drying of the silver halide photographic emulsion on the support may be carried out by such known methods as of the dip coating, roller coating, bead coating, curtain flow coating or the like, followed by drying.

The present invention may be applied not only to silver halide color photographic light-sensitive materials for general use, of the reversal process type, of the direct positive type, of the diffusion transfer process type, of the silver-dye bleach process type, etc. but also, where such a coupler as to produce neutral black is used, i.e., in the case of the so-called colorless coupler, to silver halide B/W photographic light-sensitive materials for general use, for X-ray use, for photomechanical use, for aerial photography use, for electron-recording use, and the like.

Examples of the present invention as illustrated below, but the present invention is not limited thereto:

EXAMPLE 1

An yellow color former-dispersed liquid containing an yellow color former having the formula given below was added to a chemically ripened silver chlorobromide emulsion (A) into which is incorporated a sensitizing dye, exemplified compound (2) in the quantity of $2.0\times10^{-4}$ mol per mol of silver, and after that to the mixture were added a solution prepared so as to have the compositions in accordance with No. 1 to No. 3 of Table 1, and further 10 ml of a 2% methanol solution of N,N',N''-triacryloyl-6H-S-triazine as a hardener, whereby coating liquids No. 1 to No. 3 were prepared.

In like manner, coating liquids No. 4 to No. 6 were prepared by the use of silver chlorobromide emulsion (B) containing another sensitizing dye, exemplified compound (4) in the quantity of $2.2\times10^{-4}$ mol per mol of silver.

Again in like manner, coating liquids No. 7 to No. 9 were prepared by the use of silver chlorobromide emulsion (C) containing sensitizing dye, exemplified compound (3) in the quantity of $1.0\times10^{-4}$ mol and exemplified compound (4) in the quantity of $1.1\times10^{-4}$ mol per mol of silver.

The yellow color former used herein has the formula:

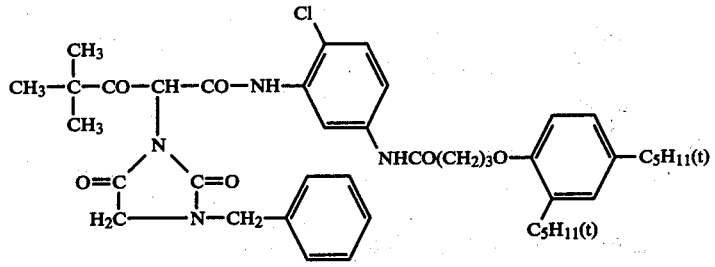

TABLE 1

| Sample No. | Emulsion | Sensitizer, (× $10^{-4}$ mol/AgBrCl 1 mol) | Adding amount | Solvent, | Amount (ml) | Remarks |
|---|---|---|---|---|---|---|
| 1 | A | Blank | | — | — | Control |
| 2 | A | Exemplified compound (2) | 1.0 | Water | 50 | Invention |
| 3 | A | Exemplified compound (2) | 2.0 | " | " | Invention |
| 4 | B | Blank | | — | — | Control |
| 5 | B | Exemplified compound (4) | 1.1 | Water | 50 | Invention |
| 6 | B | Exemplified compound (4) | 2.2 | " | " | Invention |
| 7 | C | Blank | | — | — | Control |
| 8 | C | Exemplified compound (3) | 0.5 | Water | 50 | Invention |
| | | Exemplified compound (4) | 0.6 | | | |
| 9 | C | Exemplified compound (4) | 1.0 | " | " | Invention |
| | | Exemplified | 1.1 | | | |

TABLE 1-continued

| Sample No. | Emulsion | Sensitizer, Adding amount ($\times 10^{-4}$ mol/AgBrCl 1 mol) | Solvent, | Amount (ml) | Remarks |
|---|---|---|---|---|---|
| | | compound (4) | | | |

Each of the above-prepared coating liquids was partly coated as it was, partly was allowed to stand for three hours at 40° C. and then coated, and partly was allowed to stand for 6 hours at 40° C. and then coated, respectively on polyethylene-coated sheets of paper and then dried, whereby silver halide photographic light-sensitive material samples.

Each of these resulting samples was exposed through an optical wedge to light, and processed and dried in accordance with the following processing steps, and subsequently subjected to sensitometry tests using SAKURACOLOR Densitometer PDA-60 (manufactured by Konishiroku Photo Industry Co., Ltd.). The relative speeds of the samples were determined with the speed of the non-aged samples regarded as 100. The results of them are as shown in Table 2.

In addition, all the samples were processed under the following conditions:

| Processing steps (at 32.8° C.) | Period |
|---|---|
| Color development | 3 min. 30 sec. |
| Bleach-fixing | 1 min. 30 sec. |
| Washing | 3 min. 30 sec. |
| Drying | |

| Composition of the color developing solution: | |
|---|---|
| N—ethyl-N—β-methanesulfonamide ethyl-3-methyl-4-aminoaniline sulfate | 4.0 g |
| Hydroxylamine sulfate | 2.0 g |
| Potassium carbonate | 25.0 g |
| Sodium chloride | 0.1 g |
| Sodium bromide | 0.2 g |
| Anhydrous sodium sulfite | 2.0 g |
| Benzyl alcohol | 10.0 ml |
| Polyethylene glycol (average polymerization degree 400) | 3.0 ml |
| Water to make 1 liter | |
| Use sodium hydroxide to adjust the pH to 10.0 | |

| Composition of the bleach-fixing solution: | |
|---|---|
| Sodium-iron ethylenediamine tetraacetate | 60.0 g |
| Ammonium thiosulfate | 100.0 g |
| Sodium hydrogensulfite | 20.0 g |
| Sodium metabisulfite | 5.0 g |
| Water to make 1 liter | |
| Use sulfuric acid to adjust the pH to 7.0 | |
| Oxidation-reduction potential | 70 mV |

TABLE 2

| Sample No. | Relative speed Non-aged | Aged for 3 hours | Aged for 6 hours |
|---|---|---|---|
| 1 | 100 | 82 | 71 |
| 2 | 100 | 98 | 95 |
| 3 | 100 | 101 | 98 |
| 4 | 100 | 80 | 63 |
| 5 | 100 | 98 | 92 |
| 6 | 100 | 100 | 99 |
| 7 | 100 | 83 | 69 |
| 8 | 100 | 98 | 96 |
| 9 | 100 | 99 | 98 |

As apparent from Table 2, the samples of the present invention have always constant sensitivities even when the coating liquids thereof are subjected to aging over extensive periods.

In addition, the average particle size of the silver halide particles was 0.7 μm in diameter. The particle size distribution was very small and the deviation from the average particle size was within ±10%.

EXAMPLE 2

A magneta color former-dispersed liquid containing a magenta color former given below was added to a chemically ripened silver chlorobromide emulsion into which was incorporated a sensitizer, exemplified compound (12) in the quantity of $2.5\times10^{-4}$ mol per mol of silver, and then to the mixture were added a solution prepared in accordance with Table 3 and further 10 ml of a 2% methanol solution of a hardener, N,N',N''-triacryloyl-6H-S-triazine, whereby a coating liquid was prepared.

The magenta color former used herein has the formula:

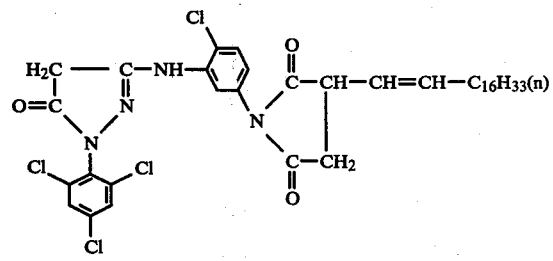

TABLE 3

| Sample No. | Sensitizer, Adding amount $\times 10^{-4}$ mol/AgBrCl 1 mol | | Solvent, | Amount (cc) | Remarks |
|---|---|---|---|---|---|
| 1 | Blank | | — | — | Control |
| 2 | Exemplified compound (12) | 1.2 | Methanol | 30 | Invention |
| 3 | Exemplified compound (12) | 2.5 | " | " | " |
| 4 | Exemplified compound (12) | 3.8 | " | " | " |

The thus prepared coating liquid was partly coated as it was, partly was allowed to stand for three hours at 40° C. and then coated, and partly was allowed to stand for 6 hours at 40° C. and then coated, respectively on polyethylene-coated sheets of paper, thus obtaining silver halide photographic light-sensitive material samples.

These samples each was exposed through an optical wedge to light and processed in accordance with the same processing and drying steps as in Example 1. After that the relative speeds were determined in a similar manner to that used in Example 1. The results are as shown in Table 4.

TABLE 4

| Sample No. | Relative speed Non-aged | Aged for 3 hrs. | Aged for 6 hrs. |
|---|---|---|---|
| 1 | 100 | 88 | 80 |
| 2 | 100 | 95 | 91 |
| 3 | 100 | 98 | 95 |
| 4 | 100 | 101 | 99 |

As shown in Table 4, the samples of the present invention have always constant sensitivities in the same way as in Example 1 even when the coating liquids thereof are stored over extensive periods.

EXAMPLE 3

A cyan color former-dispersed liquid containing a cyan color former shown below was added to a chemically ripened silver chlorobromide emulsion (A) to which was added a sensitizer, exemplified compound (16) in the quantity of $4.2\times10^{-5}$ mol per mol of silver, and to the mixture were added a solution prepared in the composition as specified in Table 5 (No. 1–3), and further 10 ml of a 2% methanol solution of a hardener, N,N',N''-triacryloyl-6H-S-triazine to thereby prepare coating liquids No. 1 to No. 3.

In like manner, coating liquids No. 4 to No. 6 were prepared using silver chlorobromide emulsion (B) into which was incorporated another sensitizer, exemplified compound (25) in the quantity of $4.0\times10^{-5}$ mol per mol of silver.

Again in like manner, coating liquids No. 7 to No. 9 were prepared using silver chlorobromide emulsion (C) into which were incorporated sensitizers, exemplified compound (16) in the quantity of $1.4\times10^{-5}$ mol per mol of silver and exemplified compound (29) in the quantity of $2.0\times10^{-5}$ mol per mol of silver.

The cyan color former used herein has the formula:

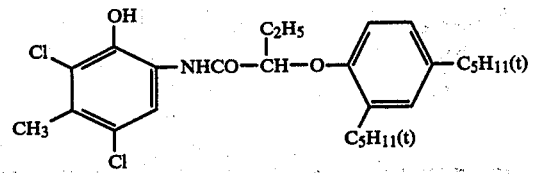

TABLE 5

| Sample No. | Emulsion | Sensitizer, (× $10^{-5}$ mol/AgBrCl 1 mol) | Adding amount | Solvent, | Amount (cc) | Remarks |
|---|---|---|---|---|---|---|
| 1 | A | Blank | | — | — | Control |
| 2 | A | Exemplified compound (16) | 2.1 | Methanol | 50 | Invention |
| 3 | A | Exemplified compound (16) | 4.2 | " | " | " |
| 4 | B | Blank | | — | — | — |
| 5 | B | Exemplified compound (25) | 2.0 | Dimethyl formamide | 50 | Invention |
| 6 | B | Exemplified compound (25) | 4.0 | Dimethyl formamide | " | " |
| 7 | C | Blank | | — | " | Control |
| 8 | C | Exemplified compound (16) | 0.7 | Methanol | 50 | Invention |
| | | Exemplified compound (29) | 1.0 | | | |
| 9 | C | Exemplified compound (16) | 1.4 | " | " | " |
| | | Exemplified compound (29) | 2.0 | | | |

Each of the above-prepared liquids was partly coated as it was, partly allowed to stand for three hours at 40° C. and then coated, partly allowed to stand for 6 hours at 40° C. and then coated, and partly allowed to stand for 10 hours at 40° C. and then coated, respectively, on polyethylene-coated sheets of paper followed by drying, thus preparing silver halide photographic light-sensitive material samples.

These samples each was exposed through an optical wedge to light, and processed and dried in the same manner as in Example 1. After that the relative speeds were determined in a similar manner to that in Example 1. The obtained results are as shown in Table 6.

TABLE 6

| Sample No. | Relative speed | | | |
|---|---|---|---|---|
| | Non-aged | Aged for 3 hours | Aged for 6 hours | Aged for 10 hours |
| 1 | 100 | 82 | 69 | 52 |
| 2 | 100 | 99 | 96 | 89 |
| 3 | 100 | 100 | 99 | 97 |
| 4 | 100 | 80 | 61 | 48 |
| 5 | 100 | 98 | 94 | 87 |
| 6 | 100 | 101 | 97 | 95 |
| 7 | 100 | 83 | 68 | 50 |
| 8 | 100 | 98 | 97 | 95 |
| 9 | 100 | 99 | 98 | 97 |

As apparent from Table 6, the samples of the present invention, as in Examples 1 and 2, have always constant sensitivities even when the coating liquids thereof are stored over extensive periods.

EXAMPLE 4

In same manner as Example 3 except that a cyan color former shown below was used in place of the color former used in Example 3, coating liquids No. 1–9 were prepared.

The cyan color former used herein has the formula:

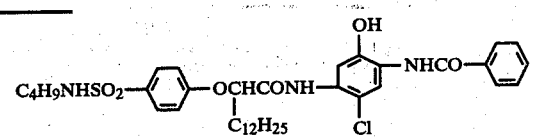

TABLE 7

| Sample No. | Emulsion | Sensitizer, (× $10^{-5}$ mol/AgBrCl 1 mol) | Adding amount | Solvent, | Amount (cc) | Remarks |
|---|---|---|---|---|---|---|
| 1 | A | Blank | | — | — | Control |
| 2 | A | Exemplified compound (16) | 2.1 | Methanol | 50 | Invention |

TABLE 7-continued

| Sample No. | Emulsion | Sensitizer, ($\times 10^{-5}$ mol/AgBrCl 1 mol) | Adding amount | Solvent, | Amount (cc) | Remarks |
|---|---|---|---|---|---|---|
| 3 | A | Exemplified compound (16) | 4.2 | " | " | " |
| 4 | B | Blank | | — | — | Control |
| 5 | B | Exemplified compound (25) | 2.0 | Dimethyl formamide | 50 | Invention |
| 6 | B | Exemplified compound (25) | 4.0 | Dimethyl formamide | " | " |
| 7 | C | Blank | | — | — | Control |
| 8 | C | Exemplified compound (16) | 0.7 | Methanol | 50 | Invention |
| | | Exemplified compound (29) | 1.0 | | | |
| 9 | C | Exemplified compound (16) | 1.4 | — | — | — |
| | | Exemplified compound (29) | 2.0 | | | |

Each of the above-prepared liquids was partly coated as it was, partly allowed to stand for three hours at 40° C. and then coated, partly allowed to stand for 6 hours at 40° C. and then coated, and partly allowed to stand for 10 hours at 40° C. and then coated, respectively, on polyethylene-coated sheets of paper followed by drying, thus preparing silver halide photographic light-sensitive material samples.

These samples each was exposed through an optical wedge to light, and processed and dried in the same manner as in Example 1. After that the relative speeds were determined in a similar manner to that in Example 1. The obtained results are as shown in Table 8.

TABLE 8

| Sample No. | Relative speed | | | |
|---|---|---|---|---|
| | Non-aged | Aged for 3 hours | Aged for 6 hours | Aged for 10 hours |
| 1 | 100 | 70 | 44 | 10 |
| 2 | 100 | 97 | 94 | 87 |
| 3 | 100 | 98 | 96 | 95 |
| 4 | 100 | 68 | 36 | 8 |
| 5 | 100 | 96 | 92 | 85 |
| 6 | 100 | 99 | 95 | 92 |
| 7 | 100 | 71 | 43 | 9 |
| 8 | 100 | 96 | 94 | 92 |
| 9 | 100 | 97 | 95 | 94 |

As apparent from Table 8, the samples of the present invention have always constant sensitivities even when the coating liquids thereof are stored over extensive periods.

What is claimed is:

1. A method of producing a silver halide photographic emulsion coating liquid comprising the steps of:
   (a) adding a first sensitizing dye to an emulsion containing silver halide particles, during the chemical ripening of the silver halide particles, to sensitize the silver halide particles; and
   (b) adding a second sensitizing dye to the emulsion containing the sensitized silver halide particles, after the chemical ripening of the silver halides particles, to form a coating liquid.

2. A method according to claim 1, wherein the coating liquid is prepared by adding the second sensitizing dye in the quantity of from 5 to 500% by weight of the amount of the first sensitizing dye.

3. A method according to claim 1, wherein the first sensitizing dye and the second sensitizing dye are the same.

4. A method according to claim 1, wherein the first sensitizing dye and the second sensitizing dye are different from each other.

5. A method according to claim 1, wherein the first sensitizing dye or second sensitizing dye is represented by the formulas (I) through (VII).

[I]

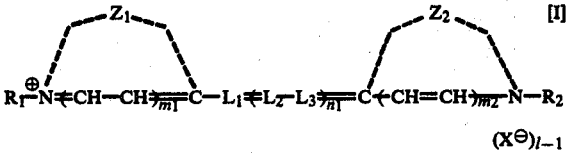

[II]

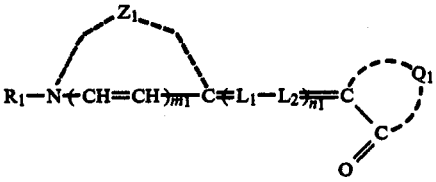

[III]

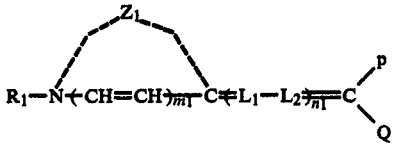

[IV]

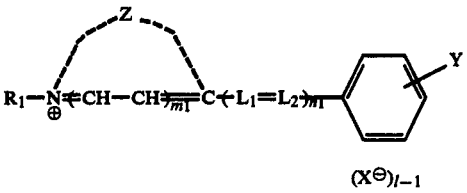

[V]

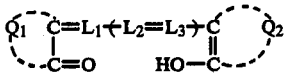

[VI]

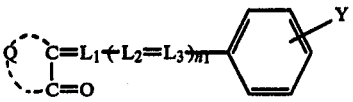

-continued

[VII]

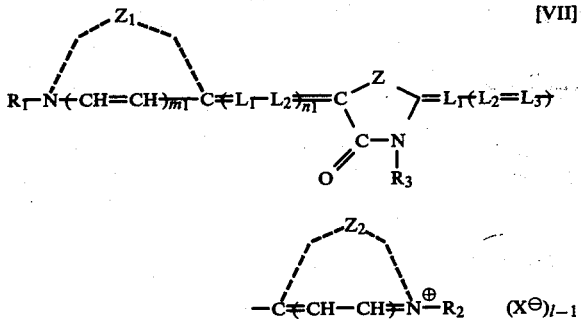

wherein $R_1$, $R_2$ and $R_3$ independently represent an alkyl or an aryl group;

$L_1$, $L_2$ and $L_3$ represent a methinyl group;

$Z_1$, $Z_2$ and $Z_3$ represent an atom or a group of atoms necessary to complete a 5- or 6-member heterocyclic nucleus;

P and Q independently represent a cyano group, $—COOR_4$, $—COR_4$ or $—SO_2R_4$ wherein $R_4$ is an alkyl group;

$Q_1$ and $Q_2$ independently represent a group of atoms necessary to form a thiooxazolone ring, a pyrazolone ring, an oxyindole ring, a barbituric acid group, a 2-thiobarbituric acid group, 2,4-oxazolidinedione ring 2,4-thiazolidinedione ring, 2,4-imidazolidinedione ring, 2-thio-2,4-oxa-zolidinedione ring, 2-thio-2,4-thiazolidine dione ring, 2-thio-2,4-selenazolidine-dione ring, 2-thio-2,5-thiazolidinedione ring, 2-thiohydantoin ring, 4-oxazolinone ring, 4-thiazolinone ring or 4-imidazolinone ring;

Y represents a hydrogen atom or a group selected from the group consisting of an amino, an alkylamino, a dialkylamino, a halogen, an alkoxy and an alkyl;

$m_1$ and $m_2$ independently represents 0 or 1; $n_1$ and $n_2$ independently represent 0 or 2;

X represents an anion group; and l represents 1 or 2, provided when the compound forms an inner salt, l is 1.

6. A method for producing a silver halide photographic light-sensitive material having on a support thereof at least one layer formed of an emulsion containing light-sensitive silver halide particles sensitized by a sensitizing dye comprising the steps of:

(a) adding a first sensitizing dye to an emulsion containing silver halide particles, during the chemical ripening of the silver halide particles, to sensitize the silver halide particles;

(b) adding a second sensitizing dye to the emulsion containing the sensitized silver halide particles, after the chemical ripening of the silver halide particles, to form a coating liquid; and (c) coating a support with the coating liquid to produce a silver halide photographic light-sensitive material.

7. The method according to claim 6, further comprising the step of drying the coating liquid on the support.

8. A method according to claim 6, wherein the silver halide photographic light-sensitive material is a color photographic light-sensitive material.

* * * * *